US005231241A

United States Patent [19]

Bissonnette

[11] Patent Number: 5,231,241

[45] Date of Patent: Jul. 27, 1993

[54] ELASTOMERIC LAUNCHER

[75] Inventor: Laurent C. Bissonnette, Narragansett, R.I.

[73] Assignee: The United States of America as represented by the Secretary of the Navy, Washington, D.C.

[21] Appl. No.: 905,704

[22] Filed: Jun. 29, 1992

[51] Int. Cl.[5] ..... F41F 3/08

[52] U.S. Cl. ..... 89/1.81; 114/238

[58] Field of Search ..... 89/1.809, 1.81; 114/238, 319, 316

[56] References Cited

U.S. PATENT DOCUMENTS 3,516,380 6/1970 Johnston ..... 114/238
4,523,538 6/1985 Hollmann et al. ..... 114/238
4,848,210 7/1989 Bissonnette ..... 89/1.81
4,854,260 8/1989 Woidich et al. ..... 89/1.81
5,044,253 9/1991 Moody ..... 89/1.81
5,085,122 2/1992 Berlam et al. ..... 89/1.81
5,099,745 3/1992 Hubbell et al. ..... 89/1.81

*Primary Examiner*—David H. Brown
*Attorney, Agent, or Firm*—Michael J. McGowan; Prithvi C. Lall; Michael F. Oglo

[57] ABSTRACT

An impulse tank is provided in the free flood compartment of a submarine to pressurize a launcher tube from sea water that has been pumped into the tank for this purpose. The tank is defined in part by the submarine hull and in part by a diaphragm bladder that is designed to expand into the free flood compartment during this pressurization.

5 Claims, 1 Drawing Sheet

ELASTOMERIC LAUNCHER

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to projectile launching from submarines, and deals more particularly with an impulse tank defined in part by the hull structure itself and in part by an elastomeric bladder, the bladder being provided as an energy storage device.

(2) Description of the Prior Art

In U.S. Pat. No. 4,848,210 an elastomeric bladder is provided in association with a projectile launch tube in the free flood compartment of a submarine hull. In this prior art construction the bladder is of generally spherical shape in its undeformed condition and to some extent at least in its deformed or distended condition. This has been found however not to be the most efficient, least costly and most maintenance free configuration.

SUMMARY OF THE INVENTION

The object of the present invention is to provide a more efficient shape for the storage tank in which the pressurized fluid will be stored so that the required volume change to service the launcher can be accommodated more efficiently than is possible with the prior art construction. In addition, it has been found that the cost of fabrication for the system of the prior art patent has been excessive and that the design of the present invention reduces the cost of fabrication, as well as contributing to lower maintenance costs.

In accordance with the present invention an impulse tank is defined in part by the submarine hull itself, and in part by an elastomeric diaphragm which can expand into the free flood compartment defined between the inner and outer submarine hulls so as to save space and yet provide the requisite degree of volume change required to eject a projectile without the need for a ram pump or turbine pump system.

DESCRIPTION OF THE PREFERRED EMBODIMENT

Figure 1:
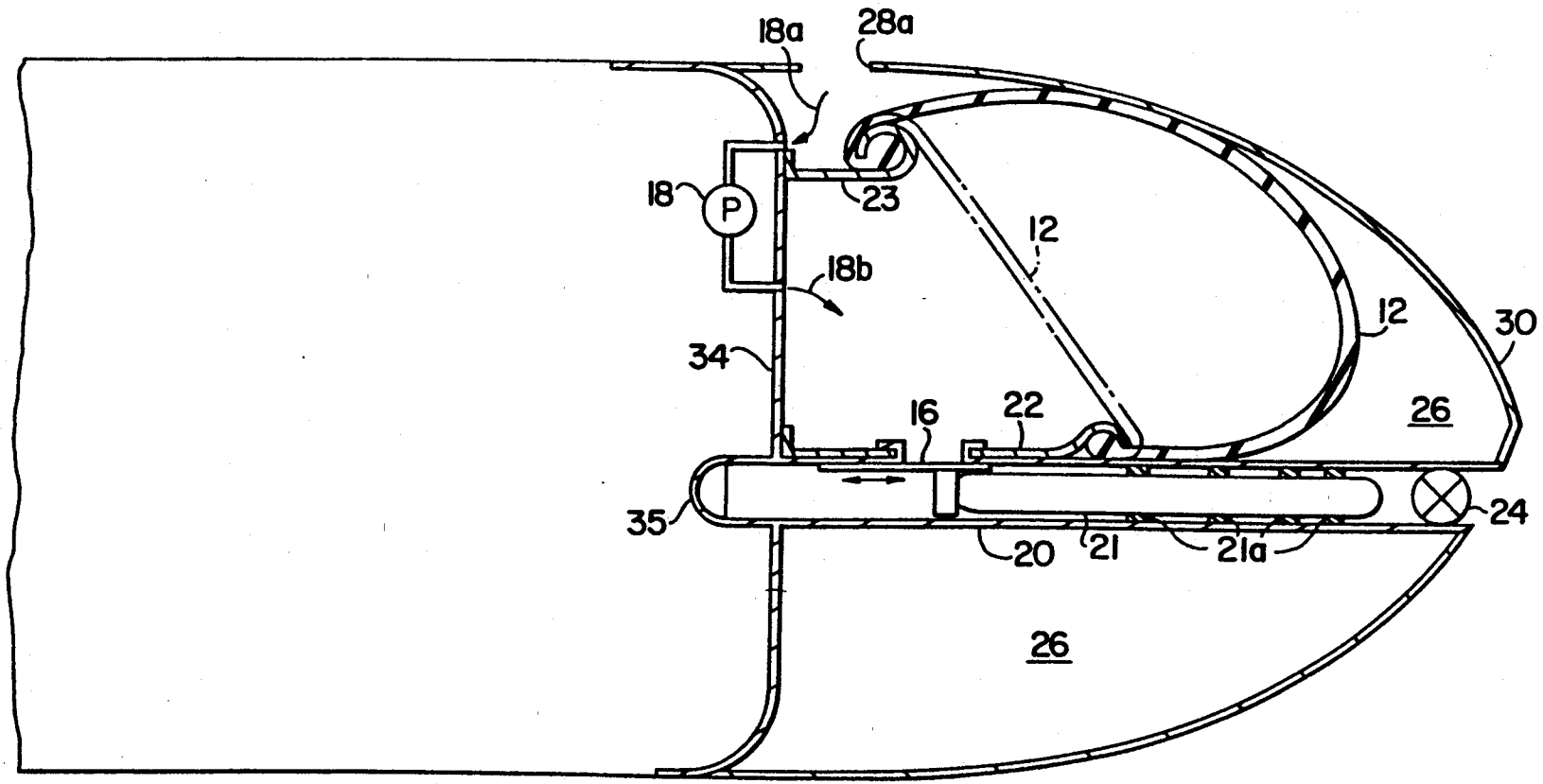
FIG. 1 shows the free flood compartment of a typical submarine as defined between the inner and outer hulls, with a launcher tube and impulse tank provided in accordance with the present invention.

Referring now to the drawing in greater detail a launcher system in accordance with the present invention is shown in the free flood compartment 26 of a typical submarine as defined between the outer hull 30 and the inner hull 34 and described in further detail in U.S. Pat. No. 4,848,210 which is hereby incorporated by reference. While the schematic drawing shows a single launching tube 20 it is understood that the launcher system to be described may be connected to a plurality of such tubes by using well known submarine piping and valving arrangements so as to direct the ejected fluid to one or more preselected launching tubes In the single launching tube version illustrated in FIG. 1 a flow controlling slide valve 16 is provided adjacent the breach end 35 of the launching tube 20. A cylindrical projectile 21 is provided on slidable chocks **21*a* so that the slide valve 16 is adapted to provide pressurized fluid between the breach end 35 of the launch tube 20 and the aft end of the projectile 21**.

The launch tube also includes a muzzle valve 24 at the launch end of tube 20. The breach end 35 can be opened from within the submarine's inner hull 34. The slide valve 16 can also be operated from within the hull 34 by conventional means (not shown). So too, the muzzle valve 24 is remotely operable from within the submarine itself. A plurality of projectiles (not shown) are generally stored within the inner hull and can be selectively maneuvered into position within the launching tube 20.

In further accordance with the present invention a pump 18 is also provided within the inner submarine hull and has a suction side adapted to draw fluid from the free flood compartment, as suggested generally by the arrow **18*a*, and a discharge side to direct pressurized fluid into the interior of an impulse tank as indicated generally by the arrow 18*b***.

In accordance with the present invention the impulse tank is selectively connected to the launcher through an opening that is normally closed by the slide valves 16. The impulse tank is defined at least in part by the submarine hull itself, and more particularly by the inner hull 34. Inner and outer impulse tank walls, 22 and 23 respectively, are provided with end portions that are adapted to receive marginal edge portions of an elastomeric diaphragm or bladder 12. These inner and outer impulse tank walls, 22 and 23 respectively, are secured to the fixed inner wall 34 of the submarine hull at their opposite ends. The inner wall 22 has a portion that cooperates with the launcher tube 20 to define the opening which is selectively closed by the slide valve 16.

As so constructed and arranged the submerged submarine can utilize pressurized water in the free flood compartment, provided through openings as suggested at **28*a*, in the outer hull 30. The water is drawn inwardly, as indicated generally by the arrow 18*a*, by the pump 18 so as to pressurize the impulse tank and to cause the elastomeric diaphragm bladder to expand from the broken line position shown in FIG. 1 to the full line position also shown in that view. This is achieved with the valve 16 in its closed position. Once the impulse tank has been so pressurized and the impulse tank isolated by check valves or the like (not shown) opening of the slide valve 16 will transfer the pressure, and fluid within the impulse tank, to the breach end of launcher tube 20 with the result that projectile 21** is fired from the submarine without the use of conventional ram pump and/or turbine type pump components.

In its preferred form the elastomeric diaphragm bladder 12 comprises a generally circular neoprene sheet having a peripheral bead which can be received in complementary shaped grooves defined by the inner and outer impulse tank walls 22 and 23. In the configuration shown the impulse tank inner and outer walls 22 and 23 preferably define a body of revolution to receive a generally circular diaphragm 12. Alternatively, the form for the elastomeric bladder 12 might take other configurations depending upon the space available within the free flood compartment of the submarine itself. In accordance with the present invention it is only necessary that the impulse tank be fabricated in part from structural metal plates such as the submarine hull itself, and in part from elastomeric elements which may be neoprene, natural rubber, or any other elastomeric compound capable of large strain.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A submarine hull comprising:

inner and outer hulls defining a free flood compartment therebetween, at least one cylindrical launch tube having a muzzle end defined by the outer hull and having a breach end defined by the inner hull and having an intermediate portion provided in the free flood compartment;

an impulse tank defining an opening into each said launch tube between said muzzle end and said breach end, said opening being located closer to said breach end of the said tube so as to be positioned behind a projectile provided in the tube;

a slide valve associated with said opening to selectively connect said impulse tank to said launch tube, said impulse tank defined in part by said submarine hull;

elastomeric bladder means also defining in part said impulse tank; and pump means having a suction side and a discharge side the suction side being connected to said free flood compartment and the discharge side being connected to said impulse tank and more particularly to said hull defined portion thereof;

whereby liquid can be pumped from said free flood compartment into the interior volume of said impulse tank thereby distending said elastomeric bladder means so that opening said slide valve releases pressurized fluid from the impulse tank into the launcher tube.

2. The combination of claim 1 wherein said hull defined part of said impulse tank comprises the inner hull of the submarine.

3. The combination according to claim 2 wherein said elastomeric bladder comprises at least one diaphragm which is generally flat in its undeformed condition, and wherein said diaphragm is adapted to conform at least in part to the shape of the outer hull when distended by fluid pressure on said impulse tank.

4. The combination according to claim 3 wherein said diaphragm shaped bladder includes enlarged bead like marginal edge portions adapted to be received in complementary shaped bladder receiving portions of said impulse tank, said bladder receiving portions of said impulse tank being defined by fixed structure located in said free flood compartment between said inner and outer hulls.

5. The combination according to claim 4 wherein said pump means is provided inside said inner hull, said suction side communicating with said free flood compartment through a port in said inner hull, and said discharge side communicating with said impulse tank interior through a second port provided in that portion of said inner hull defining said impulse tank.

* * * * *